United States Patent [19]

Lenk et al.

[11] Patent Number: 4,598,760

[45] Date of Patent: Jul. 8, 1986

[54] CLEANING ROLLER TRACKS OF WITHDRAWAL STANDS IN MACHINES FOR CONTINUOUS CASTING

[75] Inventors: Rainer Lenk, Duisburg; Harald Neuhaus, Essen; Jürgen Warner, Duisburg, all of Fed. Rep. of Germany

[73] Assignee: Mannesmann AG, Duesseldorf, Fed. Rep. of Germany

[21] Appl. No.: 374,099

[22] Filed: May 3, 1982

[30] Foreign Application Priority Data

May 8, 1981 [DE] Fed. Rep. of Germany ..... 3118977

[51] Int. Cl.[4] ..... B22D 11/00

[52] U.S. Cl. ..... 164/158; 239/178

[58] Field of Search ..... 164/158, 348, 444, 486, 164/487; 72/39, 40; 29/81 B; 15/104.16, 104.2; 134/166 C, 167 C; 239/178, 185

[56] References Cited

U.S. PATENT DOCUMENTS

| | | | |
|---|---|---|---|
| 3,897,906 | 8/1975 | Bachner | 164/444 X |
| 3,941,537 | 3/1976 | Abraham | 164/158 X |
| 3,989,093 | 11/1976 | Peitl et al. | 164/444 X |
| 4,019,560 | 4/1977 | Gruner et al. | 164/444 X |
| 4,031,946 | 6/1977 | Marti et al. | 164/444 X |

FOREIGN PATENT DOCUMENTS

| | | | |
|---|---|---|---|
| 866235 | 2/1953 | Fed. Rep. of Germany | 164/444 |
| 2526901 | 1/1977 | Fed. Rep. of Germany | 164/158 |
| 253306 | 2/1970 | U.S.S.R. | 164/158 |

*Primary Examiner*—Nicholas P. Godici
*Assistant Examiner*—Richard K. Seidel
*Attorney, Agent, or Firm*—Ralf H. Siegemund

[57] ABSTRACT

Rollers, bearings, and the support structure is cleaned by means of a frame which is being moved along the path taken by the casting. Two pneumatically movable tubes are mounted in the frame and carry at their ends U-shaped nozzle holders.

4 Claims, 2 Drawing Figures

CLEANING ROLLER TRACKS OF WITHDRAWAL STANDS IN MACHINES FOR CONTINUOUS CASTING

BACKGROUND OF THE INVENTION

The present invention relates to the cleaning of the withdrawal stand in a machine for continuous casting and, here particularly, to the cleaning of the withdrawal and support rolls in such a stand and of associated equipment.

It is known, generally, to clean the withdrawal rolls in a stand disposed downstream from a mold for continuous casting by means of pressurized water. This approach is particularly advantageous if the stand includes equipment for cooling, such as spray cooling. The cleaning process involves primarily those surfaces which are in engagement with the casting as it is withdrawn but may include the casting string as well. In all of these cases, scale is removed from the casting or from the rolls or from both, as the case may be. It was found, however, that this kind of maintenance in a machine for continuous casting is insufficient. The known equipment is particularly insufficient for removing, for example scale and other dirt from the bearings or adjoining portions. Such a scale inclusion in a bearing may, in fact, well block proper rotation of the respective withdrawal roll.

DESCRIPTION OF THE INVENTION

It is an object of the present invention to provide a new and improved cleaning device for withdrawal stands in a machine for continuous casting which permits cleaning of the rolls as well as of the bearings and of the adjacent support structure, during a pause in the casting process and in a manner which is most efficiently effective and thorough.

In accordance with the preferred embodiment of the present invention, it is suggested to provide a movable frame which includes an adjusting device, preferably a pneumatically operated adjusting device, for moving a pair of support pipes in opposite directions; these pipes carry at their respective ends U-shaped water distributors and nozzle carriers. In a protracted position, the legs of the U spray more outer portions of the rolls; and in a retracted position, more central portions of the rolls are being sprayed with water for purposes of cleaning. The nozzles should be helically arranged in the bottom part of the U-shaped nozzle carrier, and they should be arranged at different angles on the leg portions of the U.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof, will be better understood from the following description taken in connection with the accompanying drawings in which:

Proceeding now to the detailed description of the drawings, FIG. 1 shows a curved mold 1 for continuous casting of a slightly curved casting string or ingot. The casting is withdrawn by means of a withdrawal stand which includes the withdrawal rollers 2 arranged in two tracks along a commensurately curved withdrawal path. As is schematically indicated in FIG. 1, a cleaning device 3 constructed in accordance with principles of of the present invention is disposed in between the two roller tracks. The cleaning device 3 is suspended by means of a cable 5, permitting it to be lowered into the withdrawal path for the casting from above and through the machine (mold) for continuous casting. Reference No. 4 refers to hose and conduit equipment for providing pressurized air as well as water to the cleaning structure 3.

Figure 1:
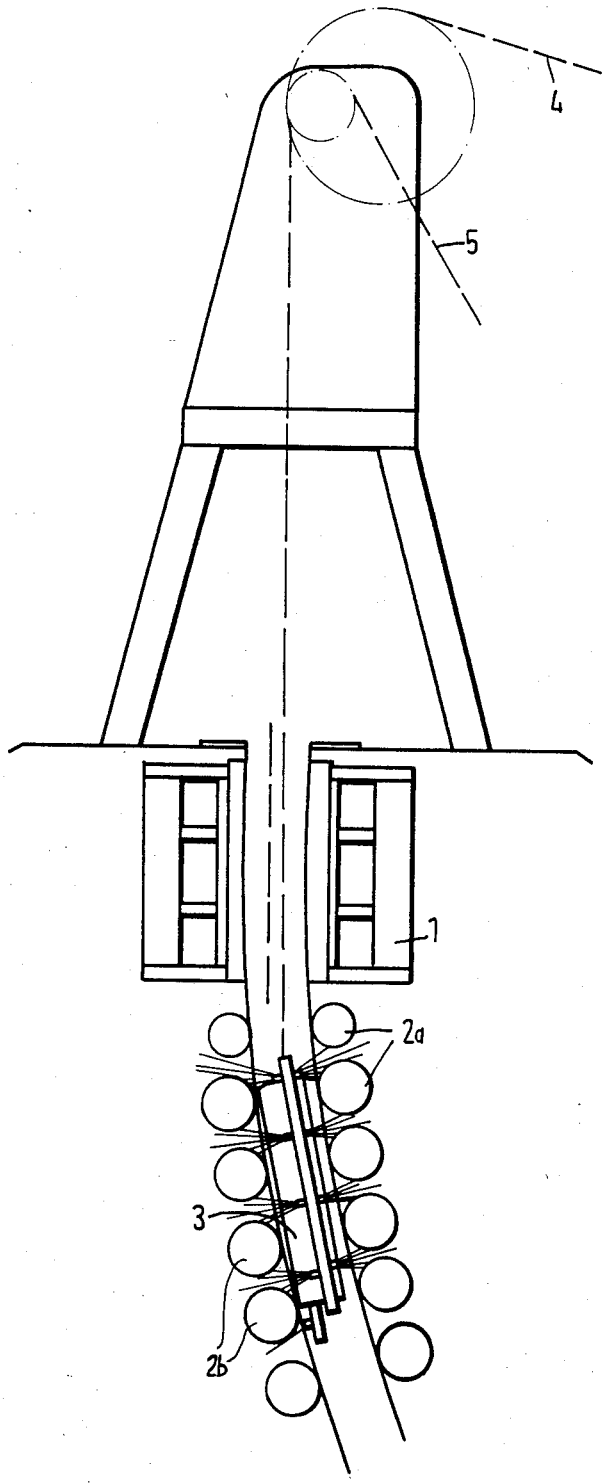
FIG. 1 is a side view of a withdrawal stand for continuous casting, showing in parts portions in longitudinal section view.
Figure 2:
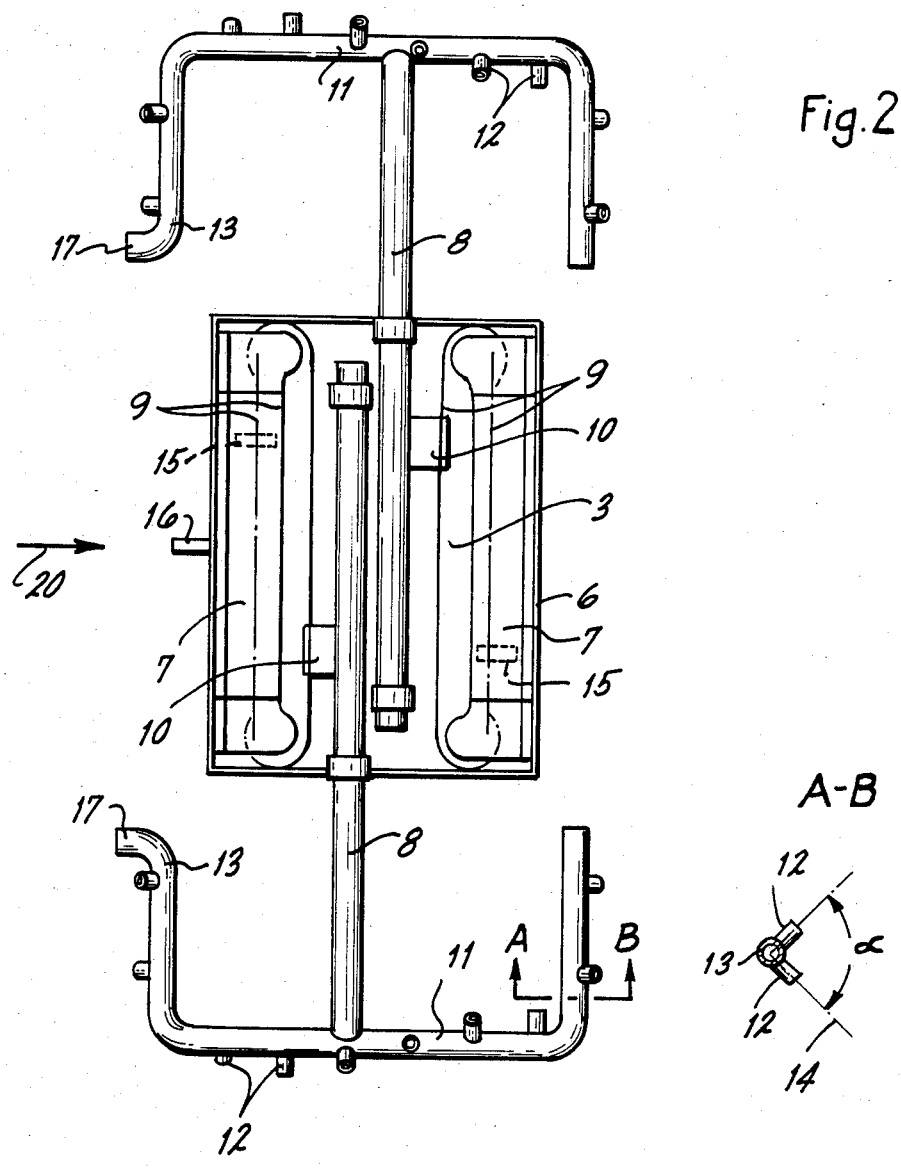
FIG. 2 is a top view of the preferred embodiment of the invention as incorporated in the equipment shown in FIG. 1 for practicing the best mode of the invention; and including in the lower right hand portion a section view as indicated by lines a and b.

Proceeding now to the description of FIG. 2, the cleaning apparatus 3 is comprised of a frame 6 which mounts and supports an adjusting structure which includes two cables 9 and cylinders 7 for operating the tow cables. Reference No. 8 refers to tubing or pipes pertaining to a spray water-distributing system, and the adjusting device is provided in order to manipulate the position of these tubes 8. As schematically indicated, the cable-actuating cylinders 7 include pistons 15 which are moved by means of pressurized air within the cylinders. The pistons 15 operate the cable 9, and these cables 9, in turn, are clamped to the tubes 8 by means of suitable fasteners 10. The particular cables are oriented so that the tubes 8 are, in fact, axially, i.e., longitudinally moved.

Tubes 8 extend beyond the frame 6 in opposite directions and carry at their respective ends spray equipment. The spray equipment includes tube sections 11 which extend in the direction 20 of casting, which is the direction of the withdrawal path. Tube sections 13 extend from the ends of tube sections 11 so that the spray equipment on each side (ends of tube 8) are of U-shaped configuration. In the case of full retraction of the tubes 8, the legs 13 of the U extend along the side of frame 6.

Nozzles 12 are, in fact, helically arranged along the circumference of the section 13, being the bottom portion of the U as it extends along the direction of casting. Additional nozzles are provided in the legs of the U-shaped configuration 13 in that the axes of adjacent nozzles are directed in different directions, the angle $\alpha$ is approximately 90° but can be as large as 170°. In any event, the nozzle axes 14 are directed out of the plane of the U. The orientation is particularly discernible from the detail FIG. 3.

As far as FIG. 2 is concerned, the rolls of the withdrawal path are disposed above and below the plane of the drawings. In other words, track rollers 2*a* extend above that plane, the axes running parallel to tubes 8, and the track rollers 2*b* are disposed parallel thereto but below the plane of FIG. 2.

Cleaning fluid, such as water under pressure of approximately eight bars, is fed to the tube system by means of hoses connected to the U-shaped water distributor system by means of connecting nipples 17. It should be mentioned in addition, that the operating and actuating cylinders of the pneumatic drives 7 are connected to a nipple 16 to which, in turn, are connected hoses for feeding controlled air pressure to the cylinder for moving the respective pistons 15 back and forth.

As outlined above, the particular frame carrying this frame equipment is suspended from a top portion of the machine for continuous casting. It is, however, possible to make the particular frame self-propelling on appropriate rails which extend along thw withdrawal and roller track. In this case, of course, it is necessary to equip the frame with appropriate drive and control means.

In operation and particularly for cleaning the withdrawal stand and the support and withdrawal rollers in the machine for continuous casting, particularly for casting rather wide slab ingots, one will proceed as follows:

In a first pass, the frame 6 is lowered with retracted equipment, i.e., the pneumatic drive has retracted the pipes 8 so that the legs 13 of the U of nozzle carrier and spray equipment extend alongside the frame. Accordingly, one cleans more central portions of the withdrawal path and roller tracks, whereby particularly the nozzles on sections 13 clean the roller surfaces from different directions and at different angles. The helically arranged nozzles on tube sections 13 contribute further to that cleaning process.

Subsequently, the frame is returned, i.e., lifted and retracted, but the tubes 8 are now extended so that the more outer portions of the tract rollers are cleaned. Due to the helical arrangement of nozzles and due to the inclined disposition of the nozzles on the legs of the u, one obtains indeed a complete cleaning of the rolls over their entire circumference, and the cleaning process includes the supporting traverses and bearing members disposed behind and next to the rolls of the track. The nozzles on sections 13 are particularly instrumental in cleaning this support equipment for the rollers.

The inventive structure offers the advantage that all elements of the roller track including the supporting structure for the rolls can, in fact, be cleaned in one continuous working cycle, amounting to moving the frame, first in one direction along the track and then retracting the frame 6 to complete the cleaning. This particular cleaning operation does not require any special personnel. Moreover, in view of the fact that the cleaning device as a whole is adjustable in the manner described, one can insert the structure into the roller tract and its frame without having to remove the mold. The mold, of course, is usually less wide than the roller track structure and its supporting frame; and for this reason, adequate space is provided for in order to lower and raise the cleaning as otherwise described.

The invention is not limited to the embodiments described above; but all changes and modifications thereof, not constituting departures from the spirit and scope of the invention, are intended to be included.

We claim:

1. An apparatus for cleaning roller tracks in machines for continuous casting, comprising:

a frame;

means for moving the frame in between the roller tracks in one or an opposite direction, along the extension of the roller track;

tubes for conducting cleaning fluid and being disposed on the frame and provided for moving laterally in opposite directions extending transversely to said direction for moving the frame, the tubes being laterally protracted and retracted from the frame accordingly; and spray means arranged at ends of the tubes for dispensing the cleaning fluid towards rollers of the track.

2. The apparatus as in claim 1, the spray means including tube sections arranged in an orientation parallel to a direction of casting being colinear with the one direction of frame moving; and nozzles helically arranged on the tube sections.

3. The apparatus as in claims 1 or 2, the spray means being of U-shaped configurations, legs of the U extending alongside said frame when the tubes are retracted.

4. The apparatus as in claim 1 or 2, the spray means including U-shaped tubing, legs of the U being provided with nozzles having axes oriented to direct spray water out of a plane as defined by the U.

* * * * *